US005694798A

United States Patent [19]

Nunez et al.

[11] Patent Number: 5,694,798

[45] Date of Patent: Dec. 9, 1997

[54] MOTORIZED LOCK ACTUATORS

[75] Inventors: Paul Nunez, Fairfield; David Sorensen, Hamden, both of Conn.; Ronald S. Slusarski, Narragansett, R.I.; Arnon Alexander, North Haven; Mohammed A. Haq, Newington, both of Conn.

[73] Assignee: Sargent Manufacturing Company, New Haven, Conn.

[21] Appl. No.: 577,869

[22] Filed: Dec. 22, 1995

[51] Int. Cl.[6] ..... E05B 47/06

[52] U.S. Cl. ..... 70/283; 70/277; 70/275; 70/224

[58] Field of Search ..... 70/283, 277, 278, 70/279, 280, 281, 282, 472, 218, 222, 223, 149, 189; 292/201

[56] References Cited

U.S. PATENT DOCUMENTS

| | | | |
|---|---|---|---|
| 3,159,993 | 12/1964 | Crepinsek . | |
| 3,898,822 | 8/1975 | Schalm . | |
| 3,948,066 | 4/1976 | Solovieff . | |
| 4,211,443 | 7/1980 | Butts et al. | 292/341.16 |
| 4,286,812 | 9/1981 | Sprekeler . | |
| 4,536,020 | 8/1985 | Thomson . | |
| 4,583,382 | 4/1986 | Hull . | |
| 4,695,082 | 9/1987 | Marks . | |
| 4,696,174 | 9/1987 | Marks . | |
| 4,736,970 | 4/1988 | McGourty et al. | 292/359 |
| 4,795,932 | 1/1989 | Long | 310/154 |
| 5,018,375 | 5/1991 | Tully | 70/472 |
| 5,083,122 | 1/1992 | Clark . | |
| 5,372,025 | 12/1994 | Lin | 70/472 |
| 5,421,178 | 6/1995 | Hamel et al. . | |
| 5,473,236 | 12/1995 | Frolov | 318/286 |
| 5,474,348 | 12/1995 | Palmer et al. . | |
| 5,544,507 | 8/1996 | Lin | 70/107 |

OTHER PUBLICATIONS

Alarm Lock DL 2500 LE–Series Digital Locks Installation Instructions, Feb. 1992.

*Primary Examiner*—Steven N. Meyers
*Assistant Examiner*—Tuyet-Phuong Pham
*Attorney, Agent, or Firm*—DeLio & Peterson, LLC

[57] ABSTRACT

A motorized lock actuator adapted to replace a mechanical lock actuator in preexisting and installed lock assemblies to convert them to electronic operation includes an electrically insulated motor housing and at least one electrically insulated bushing on the motor shaft to prevent electrostatic discharge and EMI/RFI interference from damaging the electronic lock controller. An alignment spring is used to improve operation in misaligned lock assemblies, and a key cam of self lubricating and electrically insulating plastic provides reliable low friction operation for a sliding locking slide assembly.

24 Claims, 4 Drawing Sheets

MOTORIZED LOCK ACTUATORS

BACKGROUND OF THE INVENTION

1. Field of the Invention

This invention relates to electronically operated door locks capable of switching between the locked and unlocked states responsive to a control signal. More particularly, the invention relates to motorized lock actuators particularly designed to prevent electrostatic discharges from damaging associated electronic lock controllers and which may be incorporated into newly manufactured locks or which may be used to replace corresponding mechanical components in preexisting and installed lock assemblies to convert them to electronic operation.

2. Description of Related Art

Door locks and locksets come in a variety of configurations, including cylindrical or bored-in locks, mortise locks, and exit devices of various types. These locksets typically include an inner handle and/or an outer handle to withdraw a latch from a door frame when the handle is operated, and a lock actuator to switch the lockset between the locked and unlocked states.

Although the details vary, the lock actuator usually has a protruding locking member of some type that is moved between a locked position and an unlocked position to lock and unlock the lockset. In the locked position, the locking member interferes with the motion of one or both handles, or with the motion of some critical component of the lockset, thereby locking it. In the unlocked position, this interference is removed and the handles are free to operate the door. Electrically operated locksets have a motor or solenoid to move the locking member. Mechanical locksets are operated solely by mechanical means, such as by turning a locking knob or pressing a locking button.

With the advent of inexpensive digital electronics and the wide availability of various types of magnetic card readers, key pads, and the associated types of lock control circuits that they make possible, electrically operated locks with electronic controllers to operate them are becoming much more widely used. They are often found in hotels and other locations where it is desirable to provide more control over the locking system than is provided with ordinary mechanical locks.

One problem that has been encountered with previous electrically operated door locks, particularly with those controlled with digital electronics, is that the control circuits are susceptible to damage from electrostatic discharge (ESD). When a user walks across certain types of floor coverings and carpets, particularly in relatively low humidity conditions, an electrostatic potential of many thousands of volts is generated. This potential is sufficient to cause a painful spark between the user's hand and the door handle of a lockset when the handle is initially touched.

In present designs, the spark can travel through the handle, into the motor case, and up through the motor control leads into the control circuit of an electrically controlled lock. Such sparks carry sufficient energy to permanently damage the control circuit components and disrupt the memory and logic in the control circuit.

Related problems to the electrostatic discharge problem are electromagnetic interference (EMI) and radio frequency interference (RFI), which have also been known to disrupt the electronic memory and interfere with the operation of components that control the lock functions, store access codes, maintain the date and time, record use of the lock, etc.

Another problem with existing motorized lock actuators is that they are often expensive to construct and assemble, or difficult to disassemble for servicing due to the relatively high number of expensive metal components. Often, the components are integrated during manufacture with irreversible manufacturing processes, making the lock actuators difficult or impossible to service in the field, other than by complete replacement.

A further problem with existing motorized lock actuators is that they may bind when attempting to move between the locked and unlocked positions. Such binding can occur due to the misalignment of the motor and the other portions of the lock actuator, or due to excessive friction between the metal components of the lock actuator. Misalignment of the lock actuator components is often unavoidable because the lock actuator must be installed into a mechanical lockset which is itself misaligned.

Bearing in mind the problems and deficiencies of the prior art, it is therefore an object of the present invention to provide a motorized lock actuator which is protected against damage from electrostatic discharges, and against electromagnetic and radio frequency interference.

It is another object of the present invention to provide a motorized lock actuator which can directly replace a mechanical lock actuator to easily convert a mechanical lock to an electrically operated lock.

A further object of the invention is to provide a motorized lock actuator that is easily assembled during manufacture and easily disassembled for repair in the field with components that snap together.

It is yet another object of the present invention to provide a motorized lock actuator that is constructed with subassemblies of components that can be assembled separately, then connected together to form a motorized lock actuator, the subassemblies being easily separated and replaceable in the field for repair.

Another object of the invention is to provide a design that is constructed of inexpensive materials, yet retains the strength of more expensive materials and which provides advantages in ease of assembly.

Yet another object of the invention is to provide a motorized lock actuator that is tolerant of significant misalignment and which provides self-lubrication of critical moving components to prevent binding.

SUMMARY OF THE INVENTION

The above and other objects, which will be apparent to those skilled in the art, are achieved in the present invention which is directed to a motorized lock actuator adapted for installation in a lockset. The motorized lock actuator includes an electrically insulated motor housing and a motor mounted in the motor housing. The motor has a motor shaft, the motor shaft and motor being electrically isolated from the lockset to prevent electrostatic discharge through the motor.

The motorized lock actuator further includes a locking slide assembly having a locking rod spring inside and a locking member projecting therefrom. A locking rod shaft extends through the locking rod spring and has a radial projection for threadedly engaging the locking rod spring. The locking slide assembly slides on the locking rod shaft (when the locking slide assembly is unobstructed) to a locked position when the locking rod shaft is rotated in a first direction and to an unlocked position when the locking rod shaft is rotated in an opposite direction. The sliding motion is the result of the threaded engagement of the locking rod spring by the radial projection on the locking rod shaft. Provided that the locking slide assembly is unobstructed, as the locking rod shaft rotates, the projection threadedly follows the turns of the locking rod spring, pulling or pushing the spring and the locking slide assembly longitudinally along the locking rod shaft.

If the locking slide assembly is obstructed, however, the locking rod spring becomes compressed by the rotation of the locking rod shaft due to the engagement of the radial projection. The compression of the locking rod spring stores sufficient energy to subsequently move the locking assembly to the desired locked or unlocked position when the obstruction to the locking slide assembly is removed.

A flexible alignment spring extends between the motor shaft and the locking rod shaft to compensate for misalignment in the lockset into which the lock actuator is installed.

In the preferred design, the locking slide assembly includes a cylindrical container for containing the locking rod spring. The cylindrical container slides within a key cam between the unlocked position and the locked position. The key cam is preferably formed of an electrically insulating self lubricating plastic to increase the ESD, EMI and RFI protection and to decrease friction between the locking slide assembly and the key cam within which it moves.

In the preferred design, the cylindrical container for the locking rod spring is formed of resilient plastic and includes a container portion open at one end, and a top portion for closing the open end of the container portion to contain the locking spring. The top portion is removably snapped together with the container portion and the top portion and container portion cooperate when snapped together to retain the locking member in a tongue and groove engagement. This makes the cylindrical container easy to assemble during manufacture and easy to disassemble in the field for repair or replacement of the locking member or the locking rod spring.

In the most highly preferred embodiment, the cylindrical container has a slot at one end. The slot allows the radial projection from the locking rod shaft to pass therethrough so that the locking rod shaft may be inserted and removed from the locking assembly without having to disassemble the cylindrical container. This allows the cylindrical container to be snapped together in a first assembly stage, and later to be attached to the motor and locking rod. It also allows the cylindrical container to be removed and easily replaced as a separate subassembly in the field.

To further improve ESD, EMI and RFI resistance, the motorized lock actuator includes at least one, and preferably two electrically insulated bushings located on the ends of the alignment spring for electrically isolating the motor shaft from the locking rod shaft.

The motorized lock actuator further includes a strain relief for holding wire leads connected to the motor within the lockset. The strain relief is constructed of an electrically insulating plastic and is mounted within a rollup of the lockset. The "rollup" is that portion of a cylindrical lock that rotates when the handle is turned to retract the latch. The motorized lock actuator of this invention is shown installed in a cylindrical lockset, but is suitable for use in all types of locksets.

The assembly of the motorized lock actuator is simplified due to the preferred construction of the motor housing in which the motor housing has lever arm snap tabs to secure the motor housing in the rollup.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT

In describing the preferred embodiment of the present invention, reference will be made herein to FIGS. 1–5 of the drawings in which like numerals refer to like features of the invention.

The construction and operation of the motorized lock actuator will best be understood by first considering the description of the mechanical lockset into which the motorized lock actuator has been installed.

Figure 1:
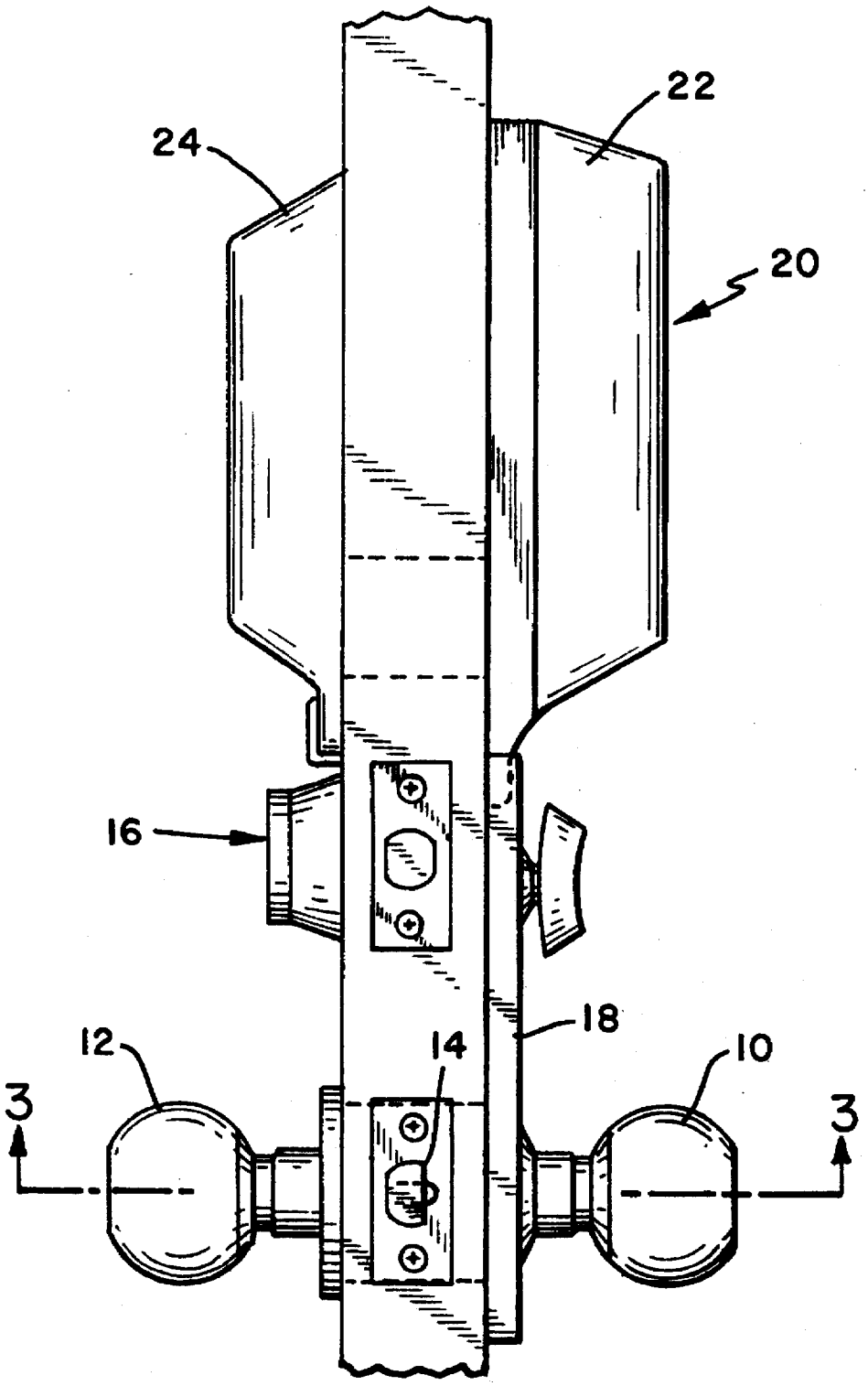
FIG. 1 is a right side elevational view of a converted mechanical lockset incorporating a motorized lock actuator according to the present invention and an electronic lock controller with a card reader for controlling the operation of the motorized lock actuator.
Figure 2:
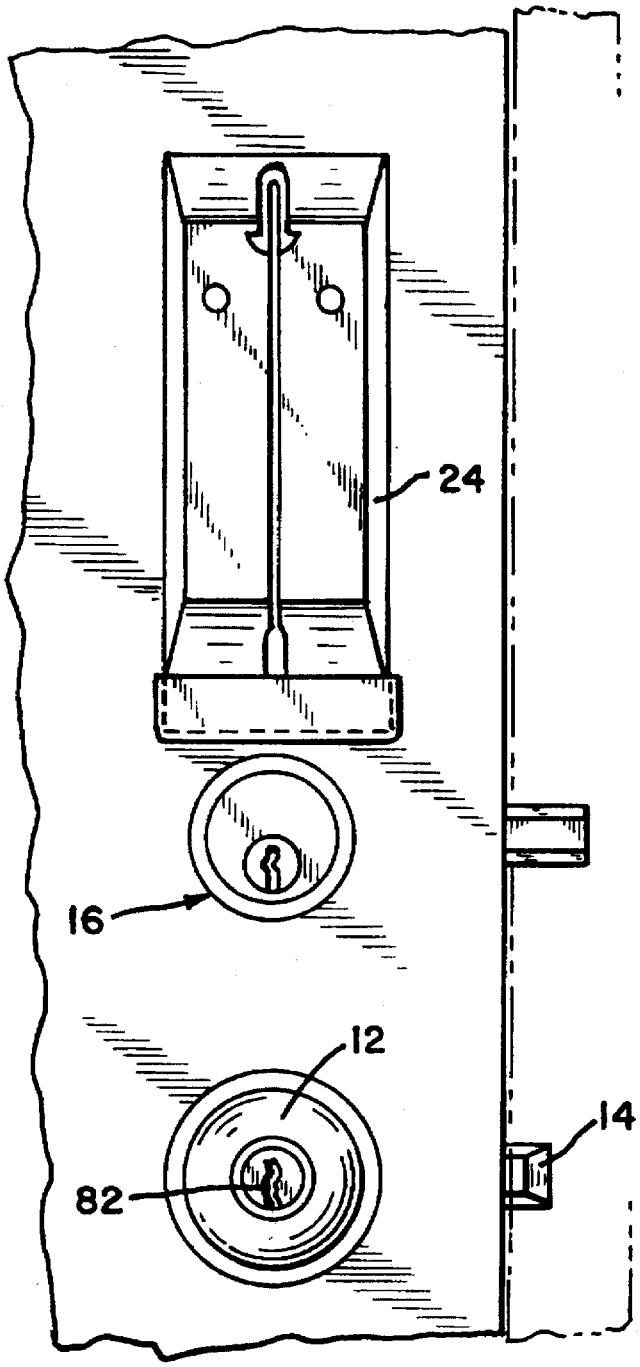
FIG. 2 is front elevational view of the converted mechanical lockset shown in FIG. 1.

FIGS. 1 and 2 show a cylindrical mechanical lockset converted into an electronic lockset through the addition of a motorized lock actuator according to the present invention and an electronic lock controller. The mechanical lockset includes an inner door knob 10, and outer door knob 12 and a latch mechanism 14. An entirely conventional deadbolt assembly 16 is also installed, and an internal cover plate 18 extends between the inner handle 10 and the inner portion of the deadbolt 16.

Figure 3:
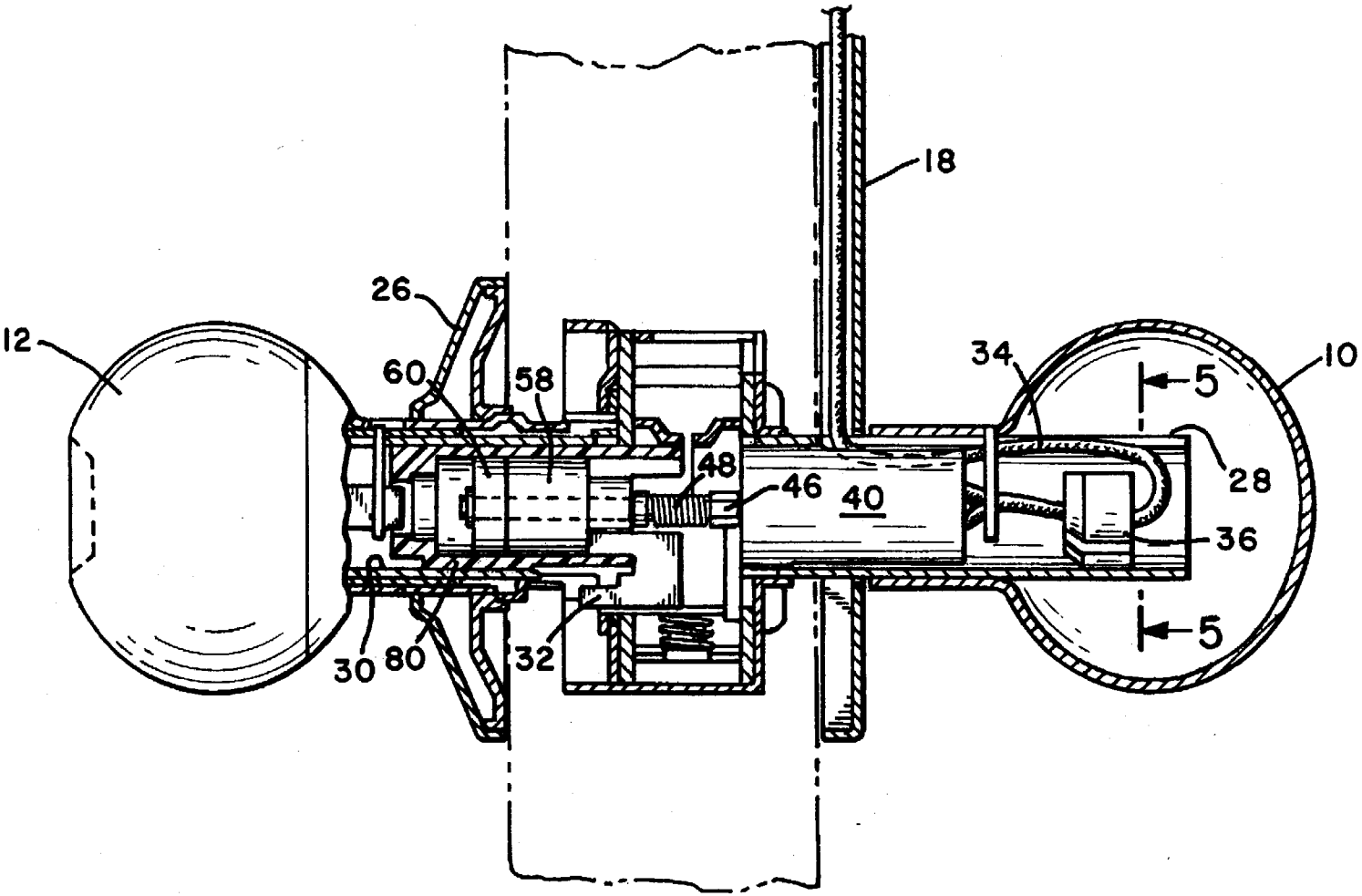
FIG. 3 is a cross-sectional view along the line 3—3 in FIG. 1 showing themotorized lock actuator of the present invention installed within the mechanical lockset.
Figure 4:
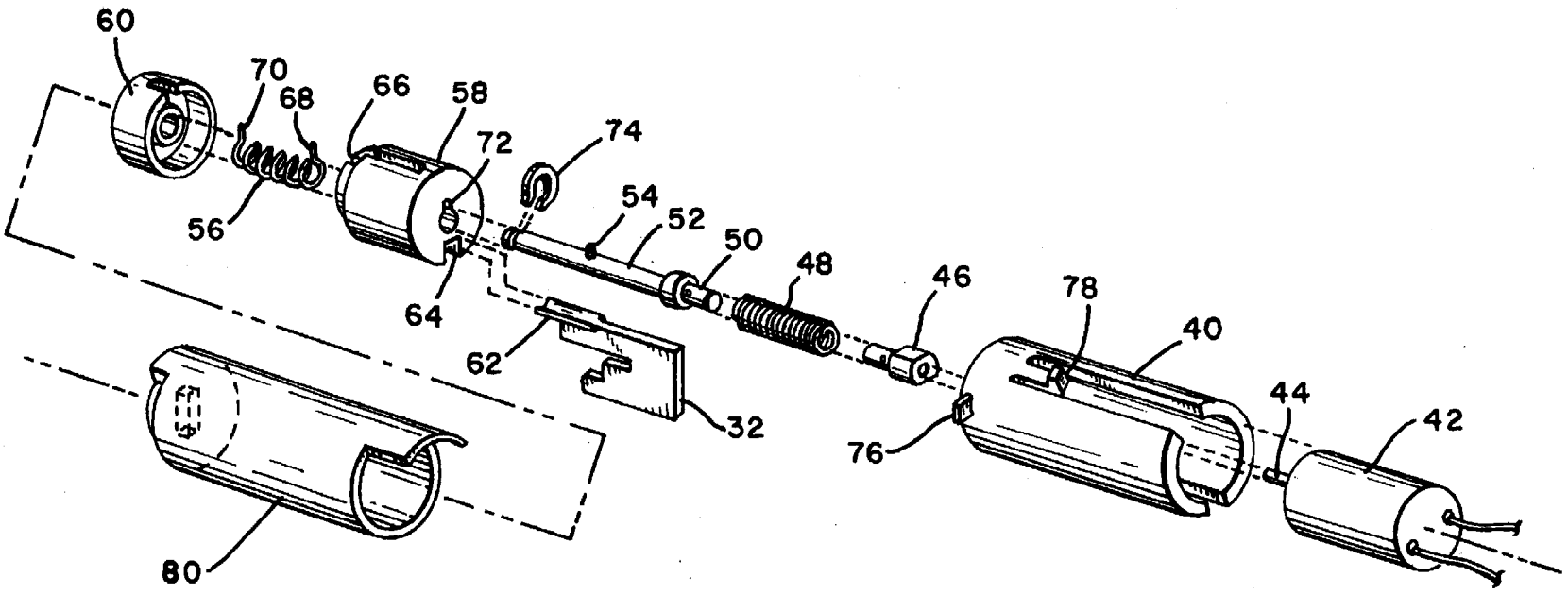
FIG. 4 is an exploded view of the motorized lock actuator of the present invention.

The mechanical lockset described above has been converted to electronic operation by the removal of the original mechanical lock actuator (not shown) and its replacement by the motorized lock actuator of the present invention as shown in FIGS. 3 and 4. The motorized lock actuator of the invention is controlled by the electronic lock controller 20 seen in FIGS. 1 and 2, which includes a controller module 22 containing most of the electronics of the lock controller and a card reader portion 24 located on the outside of the door. It will be understood that the motorized lock actuator described below may be used in connection with various types of electronic lock controllers including those with touch pads or which are operated from central control units, in addition to the card reader design shown in FIGS. 1 and 2.

FIG. 3 provides a detailed cross-section of the motorized lock actuator installed within the mechanical lockset. Referring to FIG. 3, the design of the existing mechanical lockset is conventional and includes the interior and exterior handles 10, 12 respectively, the exterior rose 26, and the interior cover plate 18. The handles 10, 12 engage corresponding rollups 28, 30 which cause the latch mechanism 14 (seen in FIGS. 1 and 2) to be retracted from the door frame when they are rotated. The exterior handle 12 and its corresponding rollup 30 are prevented from rotating by locking member 32 when the locking member 32 is in the locked position as illustrated in FIG. 3. The shape of the locking member 32 shown in FIG. 3 corresponds to the shape of the locking member on the mechanical lock actuator which was replaced by the motorized lock actuator of the present invention. Under the control of the electronic lock controller 20, the motorized lock actuator can move the locking member 32 to the right of FIG. 3 to disengage the lock or to the left (as shown) to engage the lock. The lock actuator is connected to electronic lock controller 20 through wires 34 which are directed out of the mechanical lockset and up under the cover plate 1B to the electronic lock controller 20. The wires 34 are secured in place in the interior rollup tube 28 by a strain relief 36 when locking screw 84 is tightened.

The wires 34 are preferably provided with a connector at one end for connection to electronics within the lock controller 20. At the opposite end they may be permanently attached to motor 42, as shown, or they may be provided with a second connector near to or at the motor end, thereby allowing the lock mechanism to be more easily removed and handled during servicing. In an alternative embodiment, a motor end connector of the type described is located directly at the strain relief, and the strain relief holds the connector instead of or in addition to the motor wires. This provides a firm mounting location for the motor end connector. Due to the close proximity of the motor and the strain relief, a motor end connector may extend directly from the motor into the strain relief, without the necessity for any intervening wires.

Referring to FIGS. 3 and 4, the motorized lock actuator of the present invention includes an electrically insulated motor housing 40 substantially surrounding a motor 42. The motor 42 includes a motor shaft 44 extending into a bushing 46. The bushing 46 is also preferably electrically insulating. Various types of electrically insulating plastics are suitable for constructing the bushing and the motor housing, including nylon materials and plastics sold under the tradename Delrin.

Bushing 46 is connected to an alignment spring 48 which connects to a second bushing 50 at one end of a locking rod shaft 52. The second bushing may be a separate electrically insulating bushing similar to bushing 46, or it may be integrally formed with the locking rod shaft 52. The locking rod shaft 52 includes a projection 54 which may be a radially projecting pin, or a projection that is integrally formed with the locking rod shaft 52.

The locking rod shaft has an exterior diameter which is sized to fit within the coils of locking rod spring 56 so that the spring moves along the locking rod shaft as it is rotated. The locking rod shaft may be formed of metal, or it may be formed of a nonconductive plastic to further increase the ESD/EMI/RFI resistance of the actuator.

Locking rod spring 56 is located within a locking slide assembly composed of a container portion 58 open at one end and a top portion 60. The top portion closes the open top of the container portion 58 to contain the locking rod spring 56. The locking member 32 projects out from the cylindrical locking slide assembly to lock and unlock the mechanical lockset as the locking slide assembly slides along the length of the locking rod shaft 52.

In the preferred embodiment, the container portion 58 and top portion 60 are formed of a resilient, and preferably electrically insulating plastic. A lip on the cap portion 60 and a corresponding groove on the upper perimeter of the container portion 58 cooperate to retain the cap portion 60 on the container portion 58 when the two are snapped together. In the most highly preferred embodiment, the cap portion 60 is keyed relative to the container portion 58.

The locking member 32 is held in the cylindrical locking slide assembly through the action of a tongue 62 and a corresponding groove 64 in the container portion 58. In the keyed orientation the interior shape of the cap portion 60 cooperates with the interior shape of the container portion 58 and the tongue 62 and groove 64 to hold the locking member 32 against any lateral or circumferential movement.

A longitudinal groove 66 engages the radially projecting ends 68, 70 of the locking rod spring 56 to prevent the locking rod spring from rotating within the locking slide assembly. As can be seen in FIG. 4, in the keyed orientation the longitudinal groove 66 extends into both the cap portion 60 and the container portion 58. The locking slide assembly also includes a radially formed slot 72 which is sized to accept the radial projection 54 so that the locking rod shaft 52 can be inserted into and through the locking slide assembly. C-ring 74 is then attached to the locking rod shaft 52 to retain the locking slide assembly on the locking rod shaft.

The radial projection 54 engages the helical turns of locking rod spring 56 within the container portion 58. Accordingly, as the locking rod shaft 52 is rotated by the motor 42, the threaded engagement between the projection 54 and locking rod spring 56 causes the locking slide assembly and the locking member 32 to move between the unlocked and locked positions.

On the other hand, if the locking slide assembly is obstructed and prevented from moving, the rotation of the shaft 52 acts to compress the locking rod spring 56. When the obstruction is removed, the compressed locking rod spring 56 moves the locking slide assembly to the desired position without further action from the motor. This avoids the necessity for using a sensing switch to verify that the mechanism has moved to the correct position when commanded to move by the electronic lock controller 20. It also should be noted that the two ends of the locking rod spring 56 are free, which allows the projection 54 on the locking rod shaft to rotate beyond the ends of the spring 56.

Consequently, the motor can be overdriven, i.e. commanded to turn for a larger number of turns than are on the locking rod spring 56, without damage to the motor or the spring. The excess motor rotations merely cause the projection 54 to move to the end of the spring where it repeatedly drops off the last turn of the spring for each excess rotation. As a result, it is unnecessary to accurately know the number of turns the motor 42 will rotate when commanded to turn, or to track those turns. It is sufficient to command the motor to rotate for a period that is long enough to ensure that it has rotated at least the minimum number of turns found on the locking rod spring 56. This guarantees that the motor has moved to the desired end of the spring.

In the preferred design, the motor 42 snaps into the insulating motor housing 40 which in turn snaps into the rollup tube 28 in the mechanical lockset. The motor may also be held in the motor housing by screws or any other well known means. The motor housing 40 is held in the mechanical lockset by projections 76 (which engage corresponding openings and act to prevent rotation of the motor housing) and by lever arm snap tabs 78 which snap into corresponding openings in the rollup tube 28. The locking slide assembly is also snapped together, and as described above, may be assembled separately and then placed onto the locking rod shaft 52.

This multiplicity of snapped together components allows the motorized lock actuator to be easily disassembled for repair and/or replacement of its components which is a highly desirable feature for subsequent maintenance of the lock mechanism.

Referring to FIG. 3, the outside knob 12 engages rollup 30 in a conventional manner. When the lock actuator is in the locked position as shown in FIG. 3, the locking member 32 prevents the outer rollup tube from rotating to retract the latch. The latch can still be mechanically retracted, however, even when the lock mechanism is in the locked position through the rotation of key cam 80 (shown in FIG. 4). Key cam 80 can be rotated when a correct key is inserted into external key slot 82 shown in FIG. 2.

In the original mechanical lockset, a metal key cam was provided, however, it has been found that improved operation is provided by a plastic key cam 80 made of an insulating, self lubricating and high strength plastic, such as a plastic sold under the tradename Delrin 100AF. Such plastics provide a low coefficient of friction with the locking slide assembly and in particular with the exterior of the cylindrical container formed by portions 60 and 58. Surprisingly, tests of the plastic key cam 80 show that it meets or exceeds the performance levels of a metal key cam due to the high strength plastic used and the support provided by the rollup tube and other portions of the lock actuator.

Figure 5:
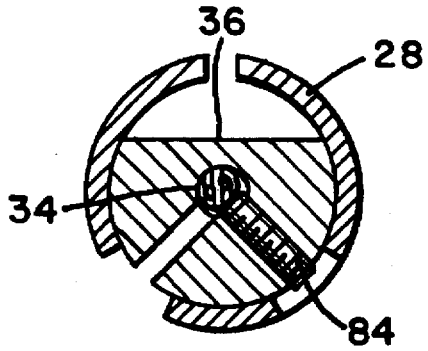
FIG. 5 is a cross-sectional view taken along the line 5—5 in FIG. 3 illustrating the strain relief of the present invention.

FIG. 5 illustrates the strain relief used to hold the motor wires 34 within the inner rollup tube to prevent damage to the motor when the lock assembly is installed.

The strain relief is preferably constructed of an insulating plastic and a plastic set screw 84 is used to securely hold the wires 34 in position.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A motorized lock actuator adapted for installation in a lockset, the motorized lock actuator comprising:

an electrically insulated motor housing;

a motor mounted in the motor housing, the motor having a motor shaft, the motor shaft and motor being electrically isolated from the lockset by the electrically insulated motor housing to prevent electrostatic discharge through the motor;

a key cam;

a locking slide assembly including a locking a cylindrical container formed of plastic sliding within the key cam, the cylindrical container having a locking member projecting therefrom;

a locking rod spring contained within the cylindrical container of the locking slide assembly, the locking rod spring having two free ends;

a locking rod shaft extending through the locking rod spring and having a radial projection for threadedly engaging the locking rod spring;

a flexible alignment spring extending between the motor shaft and the locking rod shaft; and the locking assembly sliding on the locking rod shaft, when the locking assembly is unobstructed, between a locked position when the locking rod shaft is rotated in a first direction and an unlocked position when the locking rod shaft is rotated in an opposite direction;

the locking rod spring being sufficiently compressed by the rotation of the locking rod shaft when the locking assembly is obstructed to subsequently move the locking assembly between the locked and the unlocked position when the locking assembly becomes unobstructed.

2. A motorized lock actuator according to claim 1 wherein the key cam is formed of an electrically insulating self lubricating plastic and fits within a rollup in the lockset.

3. A motorized lock actuator according to claim 1 wherein the cylindrical container comprises a container portion open at one end, and a top portion for closing the open end of the container portion to contain the locking spring, the top portion being removably snapped together with the container portion and the top portion and container portion cooperating when snapped together to hold the locking member.

4. A motorized lock actuator according to claim 1 wherein the cylindrical container has a slot at one end, the slot allowing the radial projection from the locking rod shaft to pass therethrough so that the locking rod shaft may be inserted and removed from the locking assembly without disassembly thereof.

5. A motorized lock actuator according to claim 1 further comprising at least one electrically insulated bushing located at an end of the alignment spring for electrically isolating the motor shaft from the locking rod shaft and preventing electrostatic discharge through the motor.

6. A motorized lock actuator according to claim 5 including two electrically insulated bushings located at opposite ends of the alignment spring for electrically isolating the motor shaft from the locking rod shaft and preventing electrostatic discharge through the motor.

7. A motorized lock actuator according to claim 1 further including a strain relief constructed of an electrically insulating plastic and adapted to be mounted within a rollup of the lockset.

8. A motorized lock actuator according to claim 9 wherein the strain relief is adapted to secure a connector extending from the motor to the strain relief.

9. A motorized lock actuator according to claim 1 wherein the motor housing substantially surrounds the motor, the motor housing having snap tabs to secure the motor housing in a rollup of the lockset.

10. A motorized lock actuator according to claim 9 wherein the motor housing is formed by molding and the snap tabs are formed by integrally molded levers on the motor housing.

11. An electrically operated lockset comprising:

an electronic lock controller having an output for controlling a motor to rotate in a first direction to lock the electrically operated lockset and an opposite direction to unlock the electrically operated lockset;

a mechanical lockset capable of being locked and unlocked by a lock actuator; and a motorized lock actuator fitted within the mechanical lockset, the motorized lock actuator comprising:

an electrically insulated motor housing;

a motor having a motor case, the motor being connected to the output of the electronic lock controller and the motor case being mounted in the motor housing, the motor having a motor shaft, the motor shaft and motor case being electrically isolated from the mechanical lockset by the electrically insulated motor housing to prevent electrostatic discharge through the motor to the electronic lock controller;

a key cam;

a locking slide assembly including a cylindrical container formed of plastic sliding within the key cam, the cylindrical container having a locking member projecting therefrom;

a locking rod spring contained within the cylindrical container of the locking slide assembly;

a locking rod shaft extending through the locking rod spring and having a radial projection for engaging the locking rod spring; and the locking slide assembly being slidable on the locking rod shaft between a locked position in which the locking member is positioned to lock the lockset and an unlocked position in which the locking member is positioned to unlock the lockset.

12. A motorized lock actuator according to claim 11 further including a flexible alignment spring extending between the motor shaft and the locking rod shaft.

13. A motorized lock actuator according to claim 12 further comprising two electrically insulated bushings located at opposite ends of the alignment spring for electrically isolating the motor shaft from the locking rod shaft and preventing electrostatic discharge through the motor.

14. A motorized lock actuator according to claim 11 wherein the key cam is formed of an electrically insulating self lubricating plastic.

15. A motorized lock actuator according to claim 11 wherein the cylindrical container is formed of a resilient plastic and comprises a container portion open at one end, and a top portion for closing the open end of the container portion to contain the locking spring, the top portion being removably snapped together with the container portion and the top portion and container portion cooperating when snapped together to hold the locking member.

16. A motorized lock actuator according to claim 11 wherein the cylindrical container has a slot at one end, the slot allowing the radial projection from the locking rod shaft to pass therethrough so that the locking rod shaft may be inserted and removed from the locking assembly without disassembly thereof.

17. A motorized lock actuator according to claim 11 wherein the motor housing substantially surrounds the motor, the motor housing having snap tabs to secure the motor housing in a rollup of the lockset.

18. An electrically operated lockset comprising:

an electronic lock controller;

a mechanical lockset modified by removing a mechanical lock actuator from within the mechanical lockset; and a motorized lock actuator fitted within the mechanical lockset to replace the removed mechanical lock actuator, the motorized lock actuator comprising:

an electrically insulated motor housing;

a motor connected to the electronic lock controller and mounted in the motor housing, the motor having a motor shaft, the motor shaft and motor being electrically isolated from the mechanical lockset by the electrically insulated motor housing to prevent electrostatic discharge through the motor to the electronic lock controller;

a key cam;

a locking slide assembly including a cylindrical container formed of plastic sliding within the key cam, the cylindrical container having a locking member projecting therefrom;

a locking rod spring contained within the cylindrical container of the locking slide assembly, the locking rod spring having two free ends;

a locking rod shaft extending through the locking rod spring and having a radial projection for engaging the locking rod spring; and the locking assembly being slidable on the locking rod shaft between a locked position in which the locking member is positioned to lock the lockset and an unlocked position in which the locking member is positioned to unlock the lockset.

19. A motorized lock actuator according to claim 18 further including a flexible alignment spring extending between the motor shaft and the locking rod shaft.

20. A motorized lock actuator according to claim 19 further comprising two electically insulated bushings located at opposite ends of the alignment spring for electrically isolating the motor shaft from the locking rod shaft and preventing electrostatic discharge through the motor.

21. A motorized lock actuator according to claim 18 wherein the key cam is formed of an electrically insulating self lubricating plastic.

22. A motorized lock actuator according to claim 18 wherein the cylindrical container is formed of a resilient plastic and comprises a container portion open at one end, and a top portion for closing the open end of the container portion to contain the locking spring, the top portion being removably snapped together with the container portion and the top portion and container portion cooperating when snapped together to hold the locking member.

23. A motorized lock actuator according to claim 18 wherein the cylindrical container has a slot at one end, the slot allowing the radial projection from the locking rod shaft to pass therethrough so that the locking rod shaft may be inserted and removed from the locking assembly without disassembly thereof.

24. A motorized lock actuator according to claim 18 wherein the motor housing substantially surrounds the motor, the motor housing having snap tabs to secure the motor housing in a rollup of the lockset.

* * * * *

UNITED STATES PATENT AND TRADEMARK OFFICE

CERTIFICATE OF CORRECTION

PATENT NO. : 5,694,798

DATED : December 9, 1997

INVENTOR(S) : Paul Nunez et al.

It is certified that error appears in the above-identified patent and that said Letters Patent is hereby corrected as shown below:

Column 5, line 11: delete "1B" and insert - - 18 - - .

Column 7, line 50: delete the second occurence of "a locking".

In The Claims

Column 8, line 37, claim 8: delete "9" and insert - - 7 - - .

Signed and Sealed this

Nineteenth Day of May, 1998

*Attest:*

*Attesting Officer*

BRUCE LEHMAN

*Commissioner of Patents and Trademarks*